US010233623B2

(12) United States Patent
Huang et al.

(10) Patent No.: US 10,233,623 B2
(45) Date of Patent: Mar. 19, 2019

(54) AUTOMATIC LEAK-PROOF WATER INLET DEVICE FOR A WATER TANK

(71) Applicants: So-Mei Huang, Tai Ping, Taichung (TW); THE KEENEY MANUFACTURING COMPANY, Newington, CT (US)

(72) Inventors: So-Mei Huang, Tai Ping (TW); Ted Gruska, Southington, CT (US)

(73) Assignees: So-Mei Huang, Tai Ping (TW); THE KEENEY MANUFACTURING COMPANY, Newington, CT (US)

( * ) Notice: Subject to any disclaimer, the term of this patent is extended or adjusted under 35 U.S.C. 154(b) by 109 days.

(21) Appl. No.: 15/484,549

(22) Filed: Apr. 11, 2017

(65) Prior Publication Data

US 2018/0291606 A1 Oct. 11, 2018

(51) Int. Cl.

| | |
|---|---|
| ***E03D 1/36*** | (2006.01) |
| ***E03D 1/33*** | (2006.01) |
| ***E03D 1/32*** | (2006.01) |

(52) U.S. Cl.

CPC ..... *E03D 1/36* (2013.01); *E03D 1/32* (2013.01); *E03D 1/33* (2013.01); *Y10T 137/7297* (2015.04); *Y10T 137/73* (2015.04); *Y10T 137/7361* (2015.04); *Y10T 137/7423* (2015.04); *Y10T 137/7426* (2015.04); *Y10T 137/7433* (2015.04)

(58) Field of Classification Search

CPC ..... Y10T 137/7361; Y10T 137/7423; Y10T 137/7426; Y10T 137/7433; Y10T 137/7297; Y10T 137/73; E03D 1/36; E03D 1/33; E03D 1/32

See application file for complete search history.

(56) References Cited

U.S. PATENT DOCUMENTS

| | | | | |
|---|---|---|---|---|
| 2008/0209619 | A1* | 9/2008 | Bouchard | E03D 1/00 4/300 |
| 2009/0083902 | A1* | 4/2009 | Fukuzawa | E03D 1/32 4/395 |
| 2013/0068321 | A1* | 3/2013 | Guthrie | F16K 31/34 137/434 |
| 2015/0074894 | A1* | 3/2015 | Kim | E03D 1/308 4/395 |

* cited by examiner

*Primary Examiner* — Robert K Arundale
*Assistant Examiner* — Patrick C Williams
(74) *Attorney, Agent, or Firm* — Guice Patents PLLC

(57) ABSTRACT

An automatic leak-proof water inlet device for a water tank, including an inner cylinder, an outer cylinder set, a floating casing and an assist floating set; wherein the outer cylinder set is consisted of an outer cylinder, a cover, a first connecting rod, a second connecting rod, an adjusting rod, an interlocking rod, an insert, a water stopper, a first spring and a second spring; the assist floating set includes a supporting seat and a float; by the above structure, it could stop water leakage of water tank automatically and close water inlet in time, to thereby avoid the waste of water resources.

8 Claims, 13 Drawing Sheets

AUTOMATIC LEAK-PROOF WATER INLET DEVICE FOR A WATER TANK

BACKGROUND OF THE INVENTION a) Field of the Invention

The invention relates to an automatic leak-proof water inlet device for a water tank and, more particularly, to a two-stage automatic leak-proof water inlet device for a water tank, the feature is that it could stop leakage automatically and close water inlet in time when water leakage of the sealing plug of the water tank is severe, to thereby avoid the waste of water resources.

b) Description of Prior Art

Water shortage problem is increasingly severe in recent years, governments at all levels mostly charge a fine as punishment for wasting water to remind the importance of saving water. Except a washing machine, a toilet tank is the place that consumes most water in a common family. An abnormal water-consuming situation of a toilet tank is usually the most inconspicuous one, so that consumers usually find water leakage after it happens for a long period of time, there is a punitive fine and it is also unnecessary waste of water resources.

The main reason of water tank failure is usually sealing plug leakage. In order to avoid water leakage, although many solutions have already been proposed in the industry, there is no ideal effect. For this reason, the first inventor of the present invention, has already filed an application on Mar. 11, 2016, application number U.S. patent application Ser. No. 15/067,601 (hereinafter referred to as cited reference) and the second inventor of the present invention, has already filed a provisional application No. 62/403,821 to solve common water leakage problem effectively.

Above all, leakage reason of water tank is mostly that the sealing plug cannot closely cover the flushing opening, and that is mainly because the cover face of the sealing plug is deformed. By using technique of the cited reference U.S. Ser. No. 15/067,601, this kind of water leakage could be solved to achieve the automatic leakage-proof purpose and close water inlet. But in some special cases, for example, a large particle or object in water is stopped at the position that the cover side of the sealing plug covered on the flushing opening, so that the amount of discharge water is much larger than the water of inlet water, in this case, water leakage situation would usually be difficult to detect in time, so the motion of automatically stop leakage and close water inlet may be started after a considerable period of time.

SUMMARY OF THE INVENTION

In view of this, the inventor has constantly purposed various solutions and finally completed a two-stage leakage-proof water inlet device for a water tank, namely, the object of the invention is to provide a two-stage automatic leakage-proof water inlet device for a water tank, which is provided to stop leakage automatically and close water inlet in time when it is leaking at the sealing plug of the water tank, to thereby achieve the automatic leakage-proof purpose and avoid the waste of water resources.

To achieve the object of the present invention, the automatic leak-proof water inlet device for a water tank, including:

an inner cylinder, its lower side is fixed to a bottom side of a water tank;

an outer cylinder set, which is set out on the outer periphery of the inner cylinder, the outer cylinder set is consisted of an outer cylinder, a cover, a first connecting rod, a second connecting rod, an adjusting rod, an interlocking rod, an insert, a water stopper, a first spring and a second spring; a control seat and an outlet pipe are set on the upper end of the outer cylinder, two first arms corresponding to each other are set on the control seat, an outlet chamber and an outlet pipe are set inside the control seat, the outlet chamber is communicated with the outlet tube, a pad and a socket are set between the outlet chamber and the outlet pipe, a through hole is set on the socket, an outlet hole is set on a side of the outlet chamber; the cover is set on the control seat; a first terminal is set on the inner end of the first connecting rod, a second terminal is set on the inner end of the second connecting rod, the first connecting rod and the second connecting rod is located between the two first arms; the upper end of the adjusting rod is pivoted the outer end of the second connecting rod; one end of the interlocking rod is connected to an end of a second chain, the other end of the second chain is set on a pull rod, a shaft is set on the other end of the interlocking rod, the shaft is set on the control seat, a poke piece is set on the outer end of the shaft; the top end of the insert is connected to the second connecting rod; a latch is set on the bottom side of the water stopper, the latch is inserted into the through hole of the socket, the latch is provided to move up and down to start or stop watering from the outlet pipe; one side of the first spring is fixed to the first connecting rod, the other side of the first spring is fixed to the control seat; one side of the second spring is fixed to the second connecting rod, the other side of the second spring is fixed to the control seat;

a floating casing, a first penetration opening is set on it, the first penetration opening is provided for the outer cylinder to pass through, so that the floating casing would slide up and down outside of the periphery of the outer cylinder; a loading chamber and an inlet chamber are set on the top of the floating casing, the position of the inlet chamber is higher than the loading chamber, a first outlet hole is set on the inlet chamber, a first floating chamber is set on the bottom side of the floating casing, a second outlet hole is set on the bottom of the loading chamber, the second outlet hole is communicated with the first floating chamber, the adjusting rod is connected to the periphery of the floating casing;

an assist floating set, which is set above the floating casing, the assist floating set includes a supporting seat and a float; a second penetration opening is set on the supporting seat, the second penetration opening is provided for the outer cylinder to pass through, a chamber is set on the supporting seat, a third outlet hole is set on the bottom of the chamber, the lower section of the insert is passed out through the third outlet hole; the float is placed in the chamber of the supporting seat, a top column is set on the top side of the float, a second floating chamber is set inside the float.

By the above structure, the present invention is provided for a water tank to detect water leakage automatically, to thereby close water inlet in time to achieve the automatic leakage-proof purpose, to avoid the waste of water resources.

DETAILED DESCRIPTION OF THE INVENTION

Figure 1:
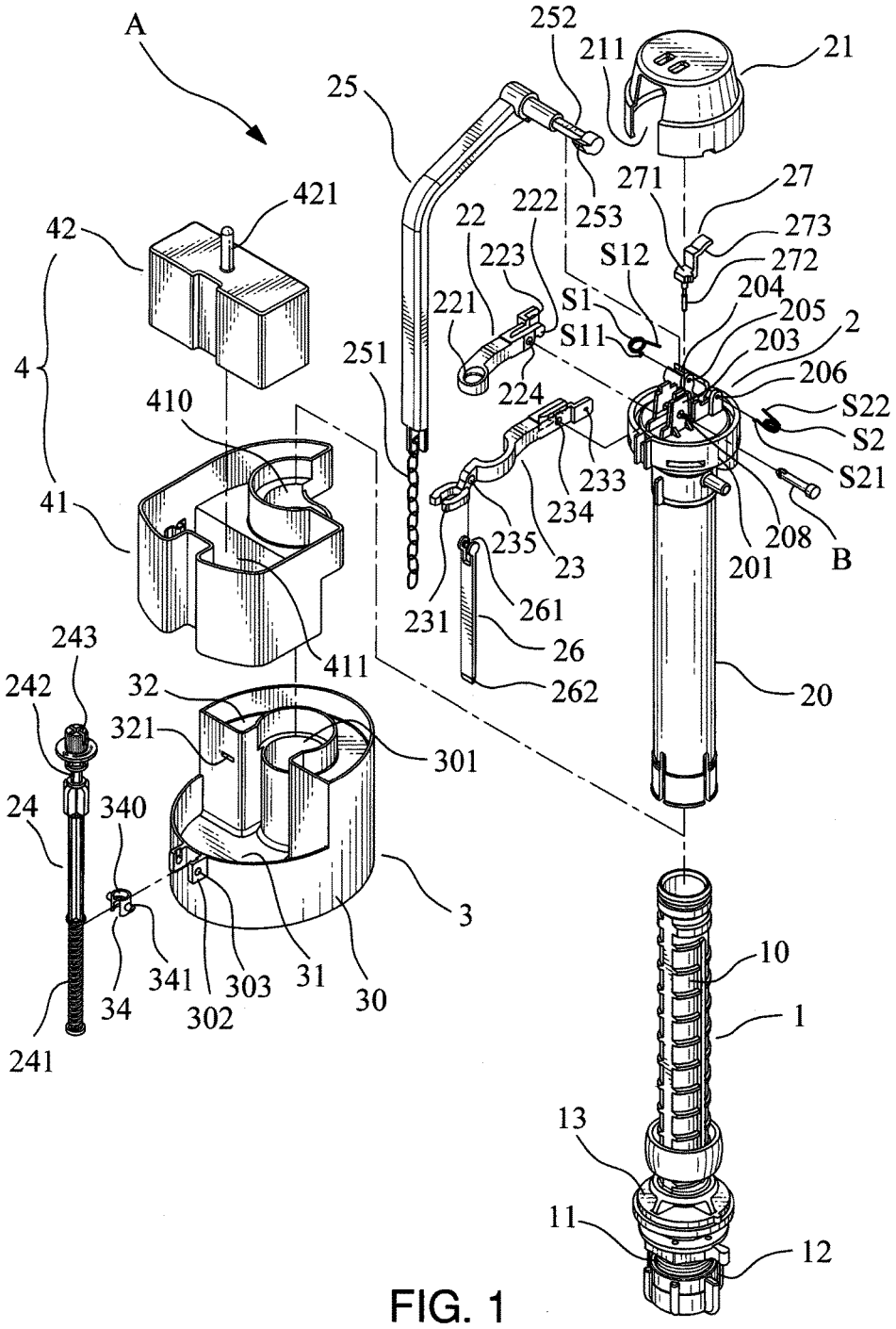
FIG. 1 is a three-dimensional exploded diagram of the present invention.
Figure 2:
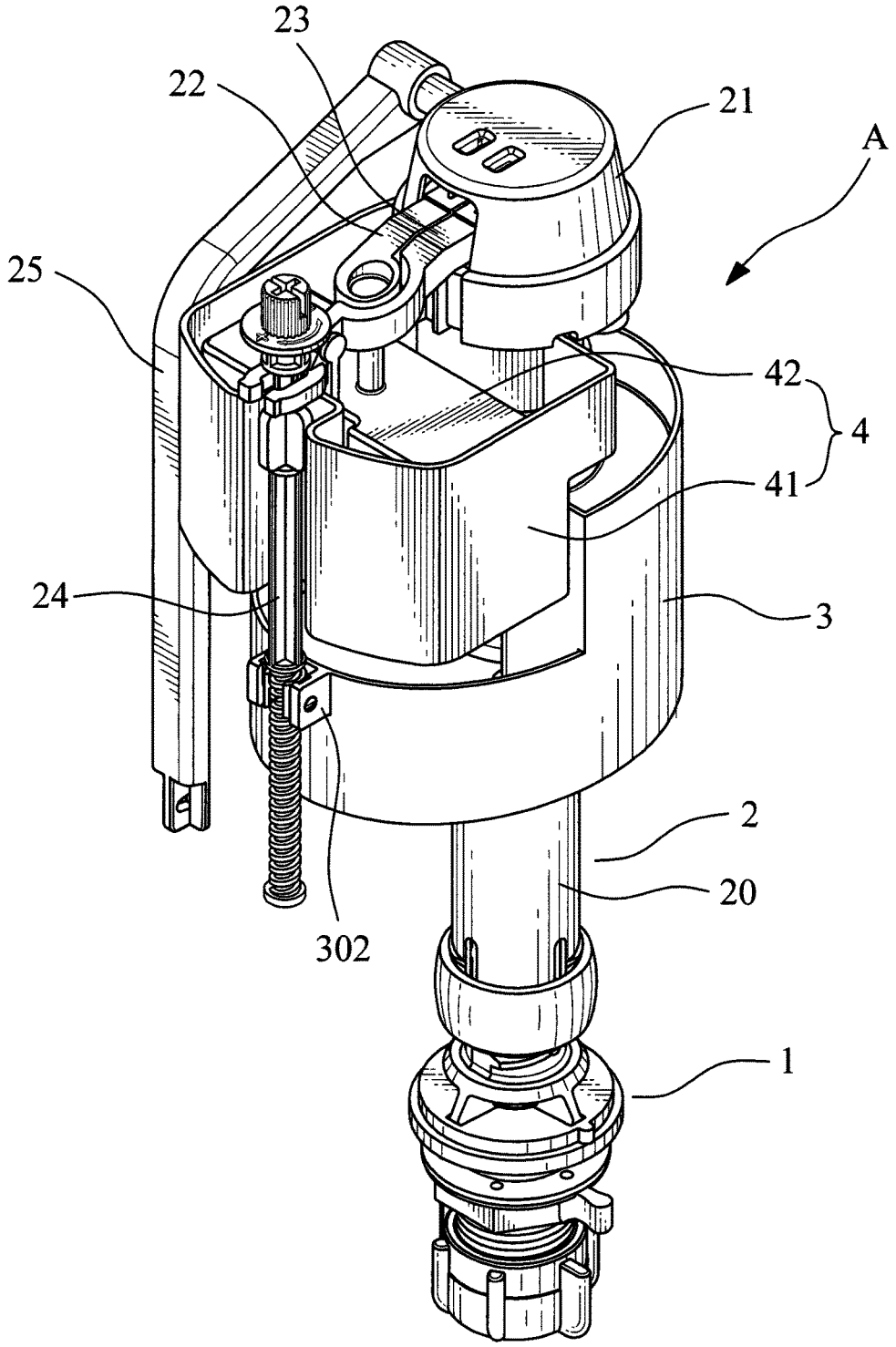
FIG. 2 is a three-dimensional diagram of the present invention.
Figure 3:
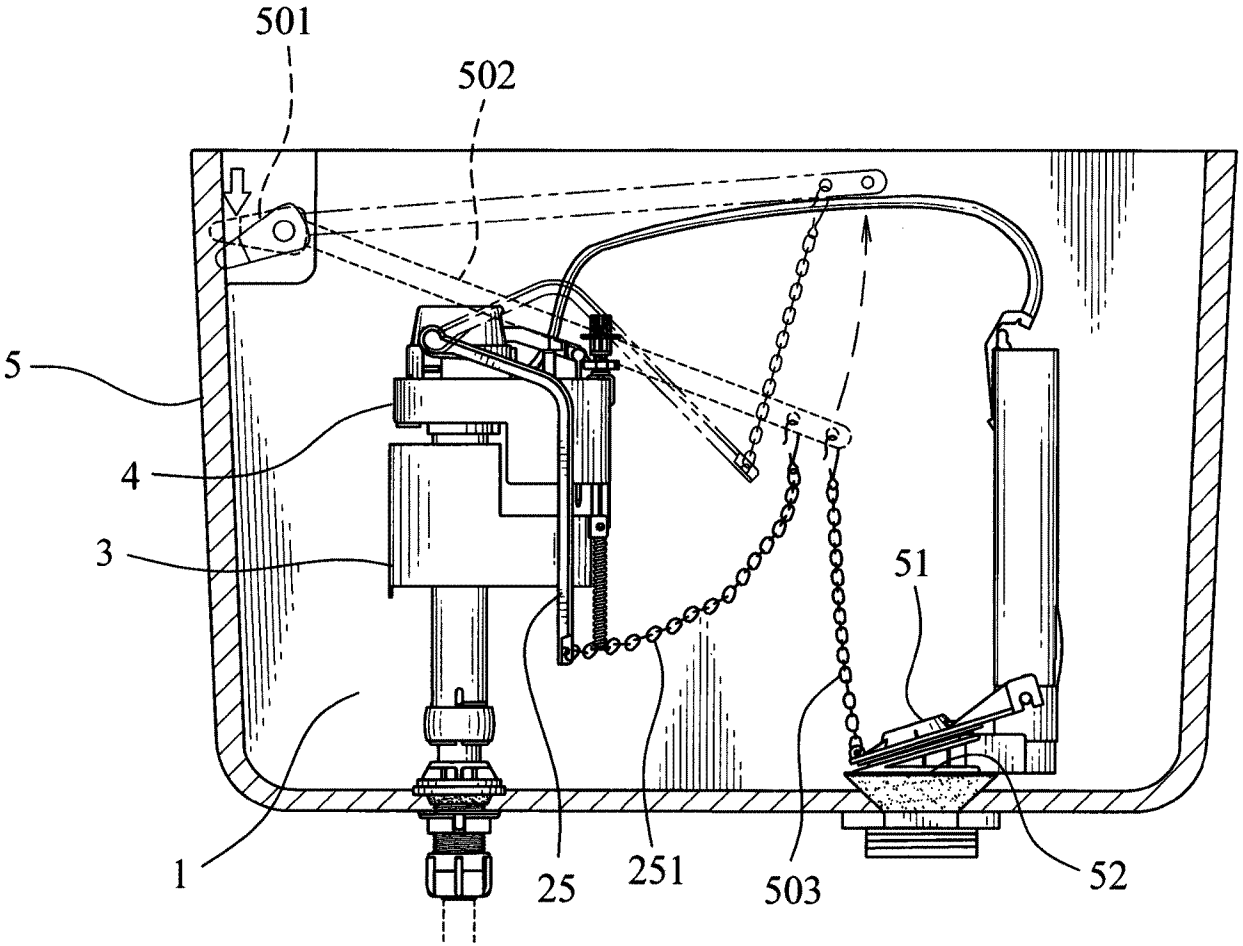
FIG. 3 is a configuration diagram of the present invention implemented in a water tank.
Figure 4:
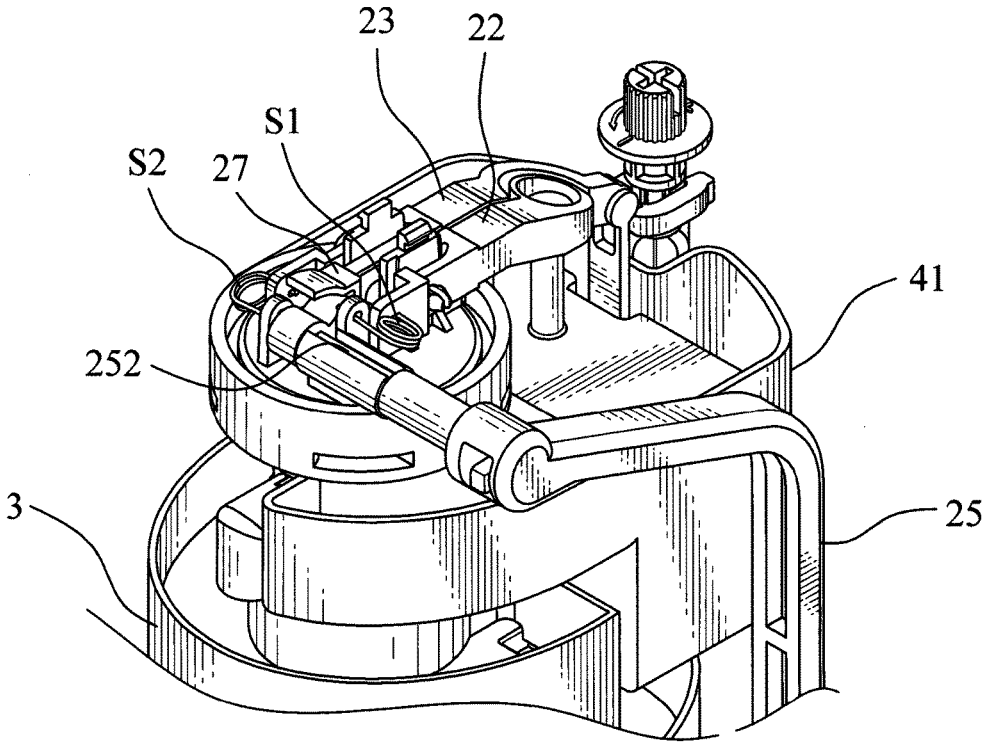
FIG. 4 is a partial three-dimensional diagram of the present invention.

As shown in FIG. 1 to FIG. 12, which is the automatic leak-proof water inlet device for a water tank of the present invention, the water inlet device A includes:

an inner cylinder 1, its lower side is fixed to a bottom side of a water tank 5, a jointing nipple 11 and multiple outlet holes 13 are set on the lower side of the inner cylinder 1, the jointing nipple 11 is set passing through the bottom side of the water tank 5 and a nut 12 is provided to fasten on it;

an outer cylinder set 2, which is set out on an outer periphery 10 of the inner cylinder 1, the outer cylinder set 2 is consisted of an outer cylinder 20, a cover 21, a first connecting rod 22, a second connecting rod 23, an adjusting rod 24, an interlocking rod 25, an insert 26, a water stopper 27, a first spring S1 and a second spring; a control seat 201 and an outlet pipe 202 are set on the upper end of the outer cylinder 20, two first arms corresponding to each other, a shaft tube 204, a first positioning hole 205 and a second positioning hole 206 are set on the control seat 201, an outlet chamber 207 and an outlet pipe 200 are set inside the control seat 201, a first shaft hole 208 is set on the first arm 203, the outlet chamber 207 is communicated with the outlet tube 202; a pad C1 and a socket C2 are set between the outlet chamber 207 and the outlet pipe 200, a through hole C21 is set on the socket C2, an outlet hole 209 is set on a side of the outlet chamber 207; the cover 21 is set on the control seat 201, an opening 211 is set on a side of the cover 21; the outer end of the first connecting rod 22 is passed through the opening 211 of the cover 2 and a pushing portion 221 is set on it; a first end 222, a third positioning hole 223 and a second shaft hole 224 are set on the inner end of the first connecting rod 22; the outer end of the second connecting rod 23 is passed through the opening 211 of the cover 2 and a pushing portion 221 is set on it, and a holder 231 and an engaging hole 235 are set on it; a second terminal 232, a fourth positioning hole 233 and a third shaft hole 234 are set on the inner end of the second connecting rod 23; the third shaft hole 234 corresponded to the second shaft hole 224 and the first shaft hole 208 is provided for a shaft bolt B to pass through to locate the first connecting rod 22 and the second connecting rod 23 between the two corresponding first arms 203; the upper end of the adjusting rod 24 is pivoted the outer end of the second connecting rod 23, an installation section 242 and an adjusting nut 243 are set on the upper end of the adjusting rod 24, the installation section 242 is provided for the holder 231 of the second connecting rod 23 to hold, an adjusting section 241 is set on the lower section of the adjusting rod 24; the end of the interlocking rod 25 is connected to an end of a second chain 251, the other end of the second chain 251 is set on a pull rod 502 (as shown in FIG. 3), a shaft 252 is set on the other end of the interlocking rod 25, the shaft 252 is set on the shaft tube 204 of the control seat 201, a poke piece 253 is set on the outer end of the shaft 252; a top end of the insert 26 is connected to the second connecting rod 23, an engaging portion 261 is set on the top end of the insert 26, the engaging portion 261 is engaged with the engaging hole 235 of the second connecting rod 23; a top holding portion 271 is set on the water stopper 27, a guide section 273 is set upwards on one side of the top holding portion 271, a latch 272 is set on the bottom side of the top holding portion 271, the latch 272 is inserted into the through hole C21 of the socket C2, the latch 272 is provided to move up and down to start or stop watering from the outlet pipe 200; a first end S11 set on one side of the first spring S1 is fixed to the third positioning hole 223 of the first connecting rod 22, a second end S12 set on the other side of the first spring S1 is fixed to the first positioning hole 205 of the control seat 201; a third end S21 set on one side of the second spring S2 is fixed to the fourth positioning hole 233 of the second connecting rod 23, a fourth end S22 set on the other side of the second spring S2 is fixed to the second positioning hole 206 of the control seat 201;

a floating casing 3, a first penetration opening 301 is set on it, the first penetration opening 301 is provided for the outer cylinder 20 to pass through, so that the floating casing 3 would slide up and down outside of the periphery of the outer cylinder 20; a loading chamber 31 and an inlet chamber 32 are set on the top of the floating casing 3, the position of the inlet chamber 32 is higher than the loading chamber 31, a first outlet hole 321 is set on the inlet chamber 32, a first floating chamber 33 is set on the bottom side of the floating casing 3, a second outlet hole 311 is set on the bottom of the loading chamber 31, the second outlet hole 311 is communicated with the first floating chamber 33, the adjusting rod 24 is connected to the periphery 30 of the floating casing 3, two corresponding second arms 302 are set on the periphery 30 of the floating casing 3, a shaft hole 303 is set on each second arm 302, the shaft holes 303 are engaged with the positioning collar 34, two support shafts 341 are set on two sides of the positioning collar 34 respectively, a hollow hole 340 is set on the positioning collar 34, the hollow hole 340 is provided to set the adjusting section 241 of the adjusting rod 24;

an assist floating set 4, which is set above the floating casing 3, the assist floating set 4 includes a supporting seat 41 and a float 42; a second penetration opening 410 is set on the supporting seat 41, the second penetration opening 410 is provided for the outer cylinder 20 to pass through, a chamber 411 is set on the supporting seat 41, a third outlet hole 412 is set on the bottom of the chamber 411, the lower section 262 of the insert 26 is passed out through the third outlet hole 412; the float 42 is placed in the chamber 411 of the supporting seat 41, a top column 421 is set on the top side of the float, a second floating chamber 422 is set inside the float 42.

The above latch 272, multiple longitudinal grooves are set on its front end (not shown in figure); when the water inlet device works, the latch 272 is used to move upwards in the through hole C21 of the socket C2, so that water could flow into the outlet chamber 207 from the longitudinal grooves; when the water inlet device stops, the latch 272 is used to move downwards in the through hole C21 of the socket C2, the rear section of the latch 272 without setting longitudinal grooves could block the through hole, so that water could not flow into the outlet chamber 207, the related structure and motion is prior art, so it is not described here in details.

Figure 5:
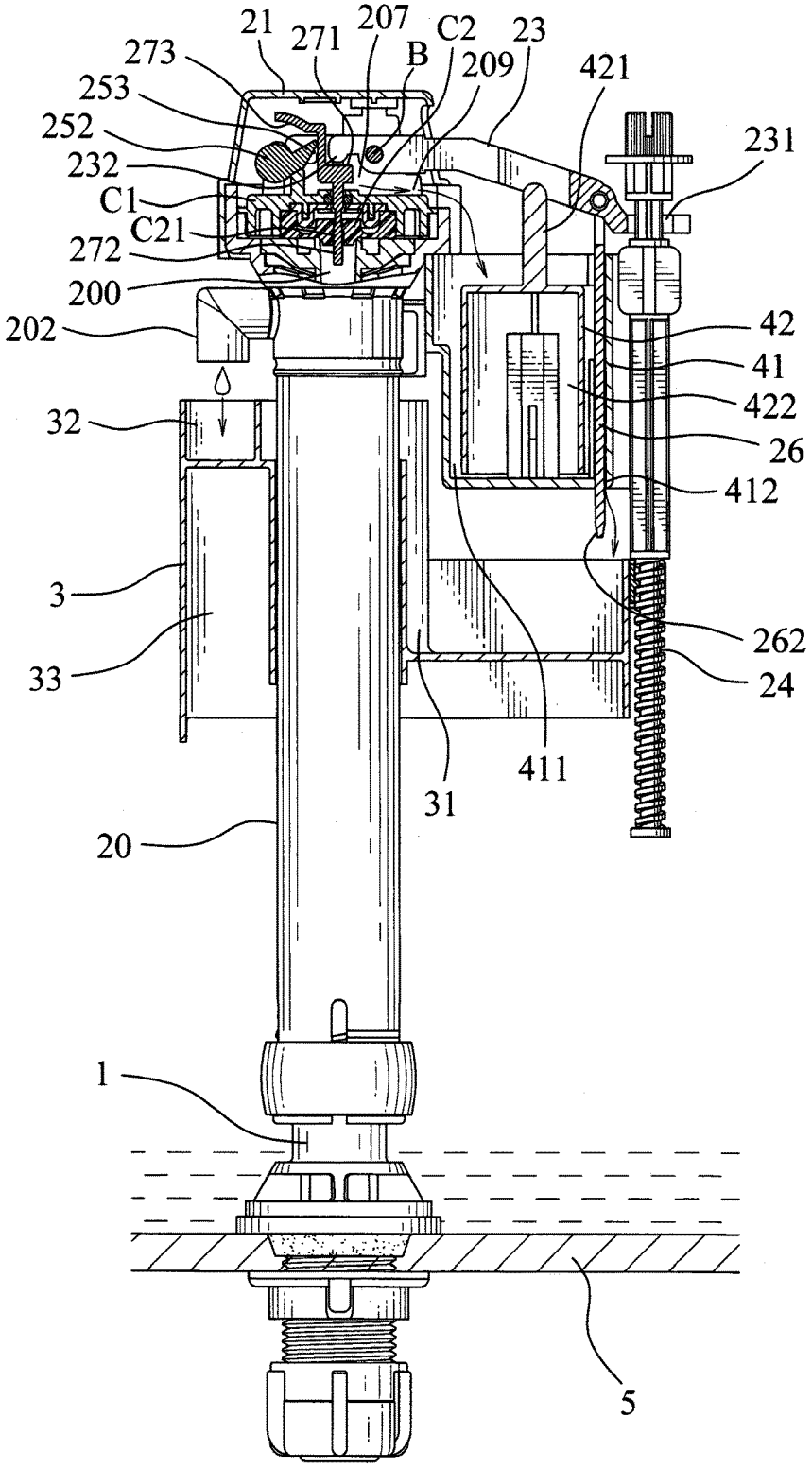
FIG. 5 is a schematic diagram of the water tank starting watering according to the present invention.

Please refer to FIG. 3 and FIG. 5, the present invention under normal condition without leakage, when a user presses the flush handle 501, the pull rod 502 is driven to pull the first chain 503 and the second chain 251 upwards, so that the sealing plug 51 is opened by the first chain 503 and the water in the water tank 5 flows out from the flushing opening 52; with the water level falling, the sealing plug 51 moves downwards and covers the flushing opening 52, the floating casing 3 also moves downwards synchronously; when the above flush handle 501 is pressed downwards, the second chain 251 synchronously drives the interlocking rod 25 to rotate, so that the poke piece 253 rotates to touch the guide section 273 of the water stopper 27, the latch 272 located in the through hole C21 is driven to move upwards, so water of the water inlet device could flow into the outlet chamber 207 through the gap between the through hole C21 and the latch 272 and flow out from the outlet tube 202 and the outlet hole 209; when the user moves his hand away from the flushing handle 501, the interlocking rod 25 reversely rotates to the original position immediately, at this time, because the elasticity of the second spring S2 is larger than the pushing force of the second terminal 232 of the second connecting rod 23, the latch 272 would not be pushed to move downwards, so water continuously flows in.

Figure 6:
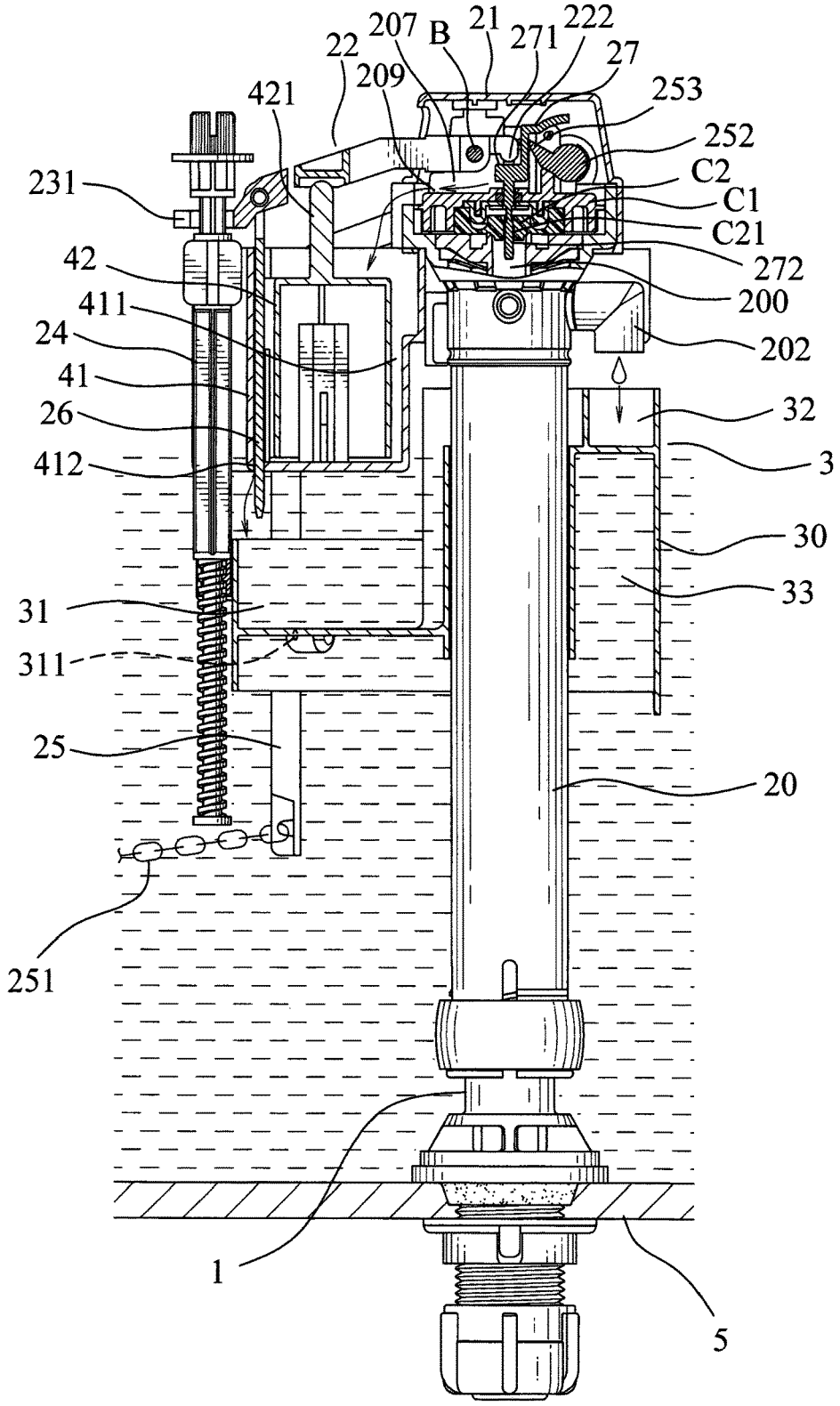
FIG. 6 is a schematic diagram of water state of the water tank according to the present invention.

As shown in FIG. 6, in the water inlet device A, water flows into the outlet chamber 207, and flows out from the outlet tube 202, the outlet hole 209; water flowed from the outlet tube 202 flows to the inlet chamber 32 of the floating casing 3 first, and flows into the loading chamber 31 from the first outlet hole 321, and finally flows into the first floating chamber 33 from the second outlet hole 311 on the bottom of the loading chamber 31 and flows into the water tank 5; water flowed out from the outlet hole 209 flows into the chamber 411 first, and flows out from the third outlet hole 412 on the bottom of the chamber 411, since the lower section 262 of the insert 26 is inserted in the third outlet hole 412, water could only flow out to the water tank 5 from the gap between the insert 2 and the third outlet hole 412, so outlet water amount is smaller.

Figure 7:
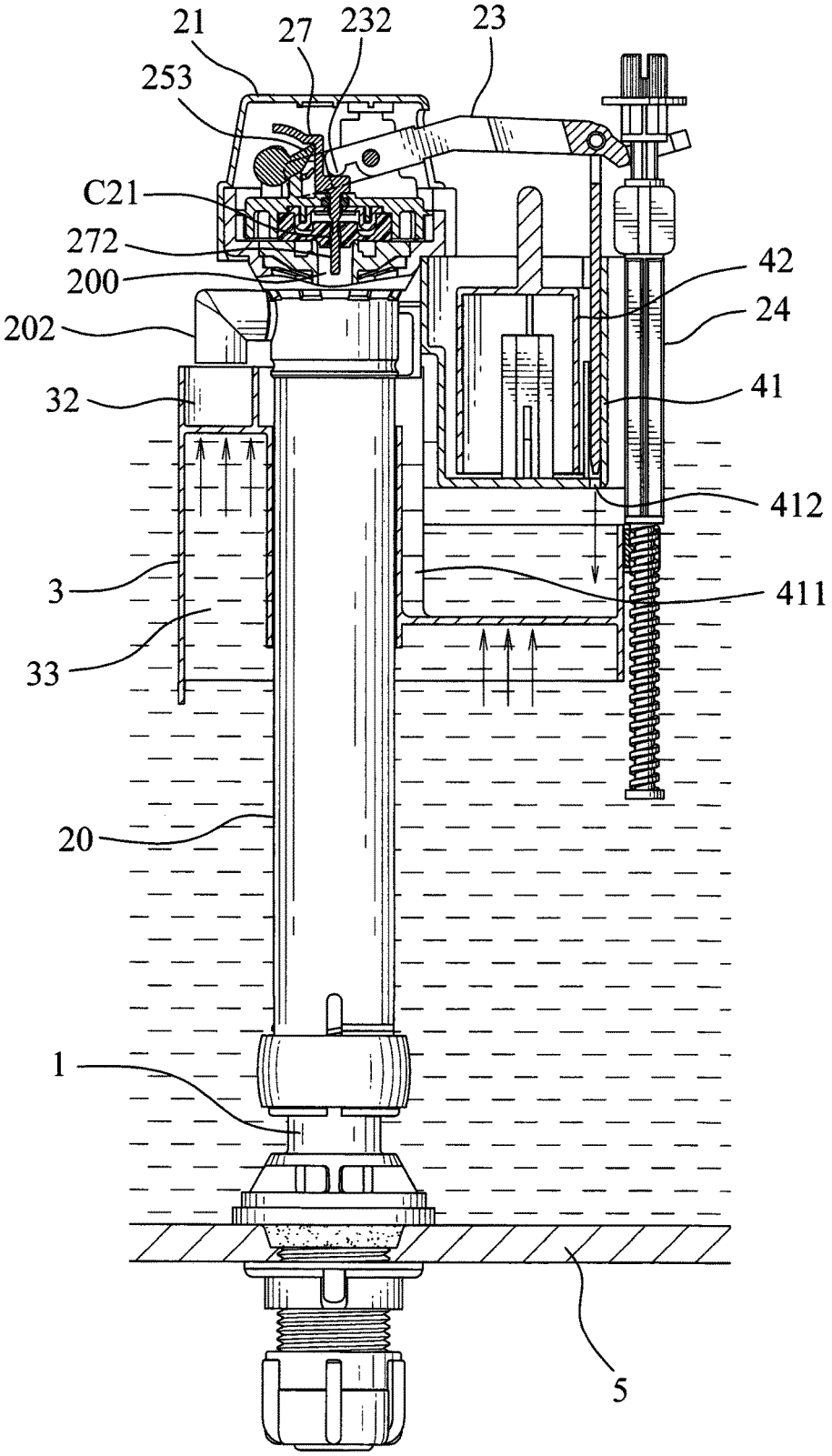
FIG. 7 is a schematic diagram of stopping water due to buoyancy of the floating casing of the present invention.

As shown in FIG. 7, when water flowed into the water tank 5 achieve the position of the water line, the floating casing 31 is pushed upwards due to the buoyancy of water, and the second connecting rod 23 is driven to rotate with the shaft B as the center, so that the second terminal 232 of the second connecting rod 23 pushes downwards on the water stopper 27, since the pushing force is greater than the elasticity of the second spring S2, the latch 272 could move downwards to stop watering.

Figure 8:
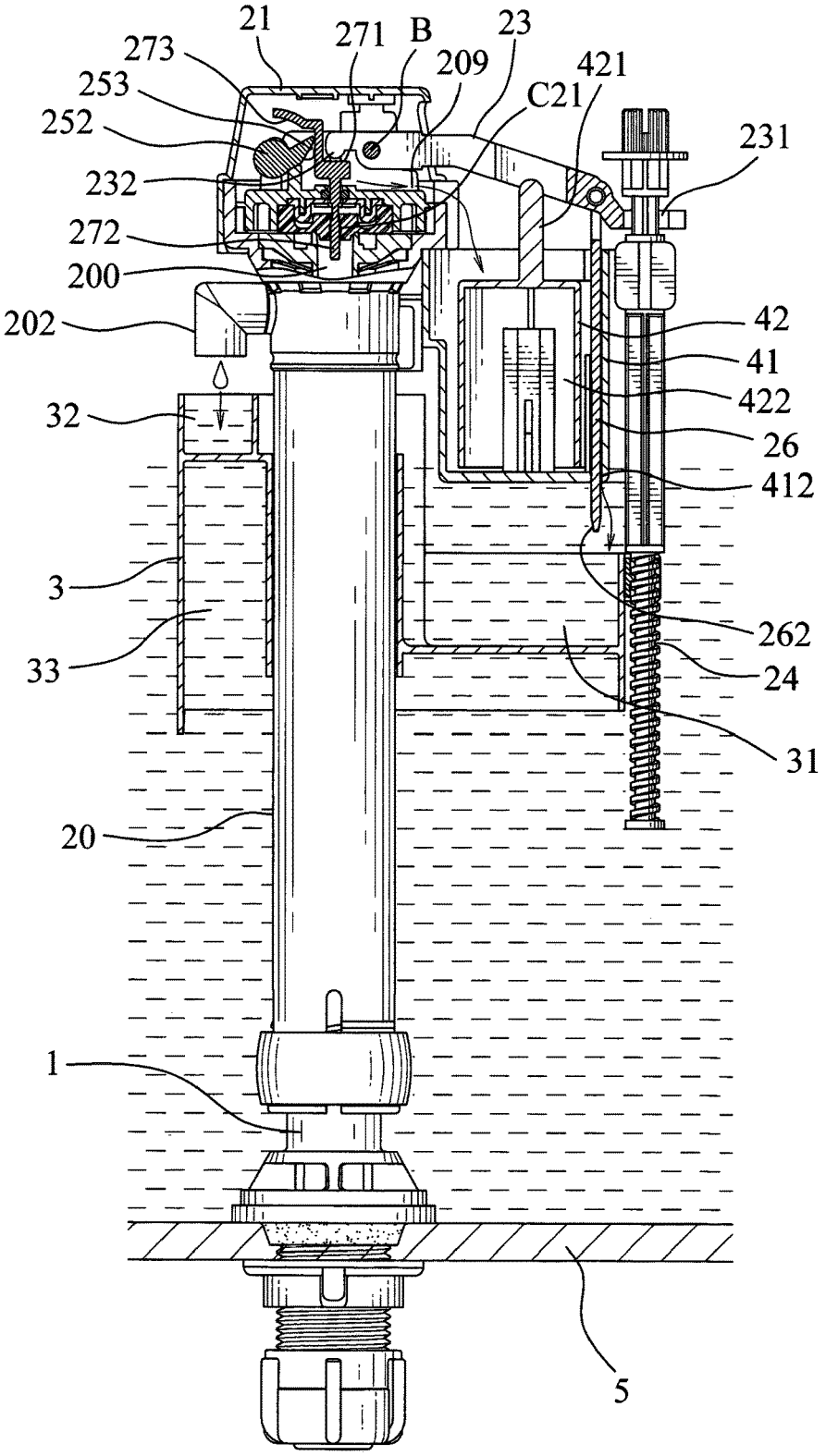
FIG. 8 is a schematic diagram of small amount of water leakage according to the present invention.
Figure 9:
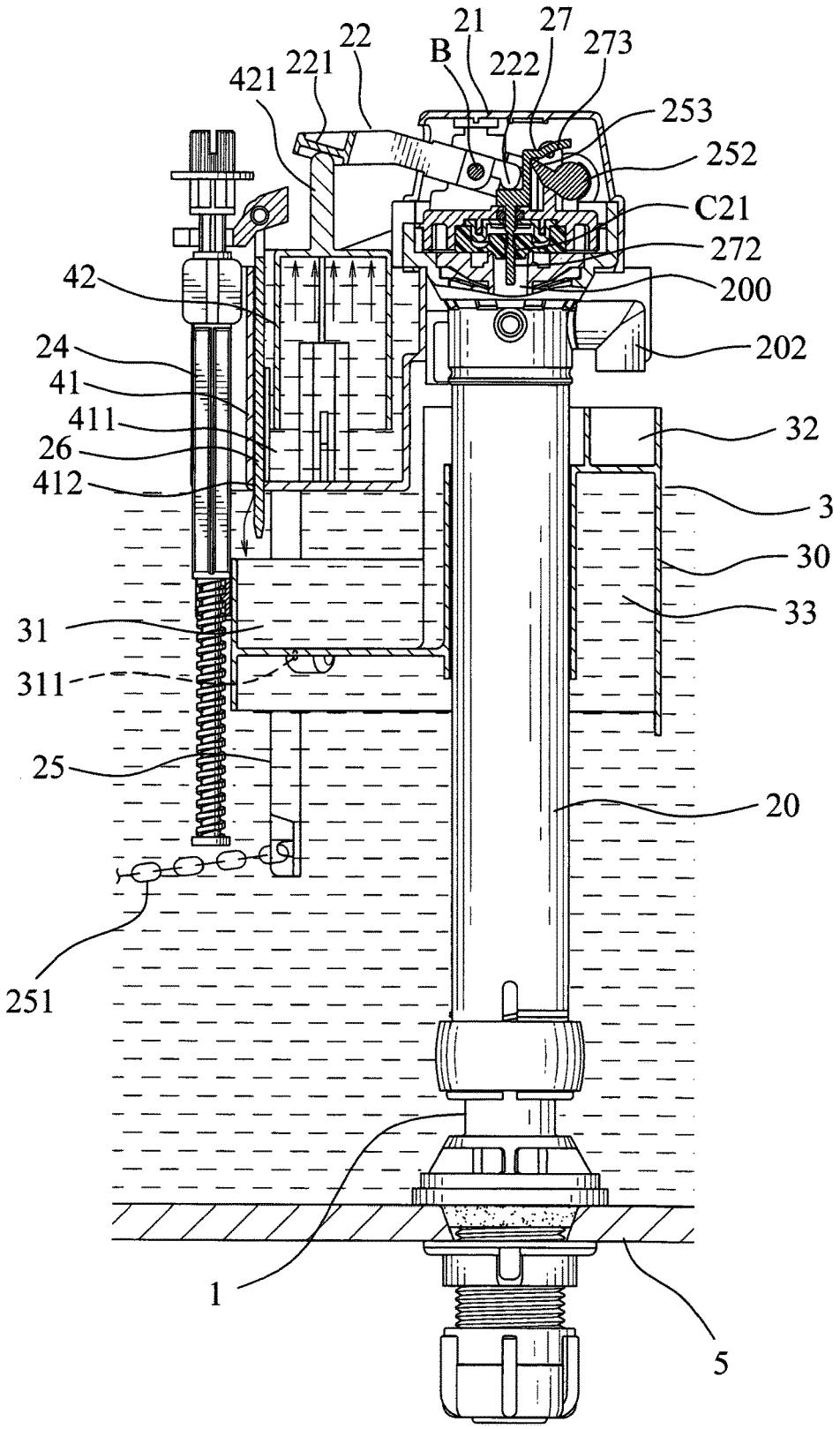
FIG. 9 is a schematic diagram of stopping water when small amount of water leakage occurs according to the present invention.

As shown in FIG. 8, when the water tank 5 is full of water, if a small leakage occurs, the floating casing 3 slightly moves downwards, so that the second terminal 232 of the second connecting rod 23 cannot entirely push the water stopper 27 for stopping watering; since the amount of water flowing in is larger than the amount of water leakage, the water tank 5 is still maintained at full water level, but the water leakage has already occurred; by using the present invention, at this time, the float 42 is pushed upwards by the buoyancy of water flowing into the chamber 411, the top column 421 is finally pushed upwards to touch the pushing portion 221 of the first connecting rod 22, so that the first terminal 222 of the first connecting rod 22 is pushed downwards on the water stopper 27, since the pushing force is larger than the elasticity of the first spring S2, the latch 272 could move downwards to stop watering (as shown in FIG. 9).

Figure 10:
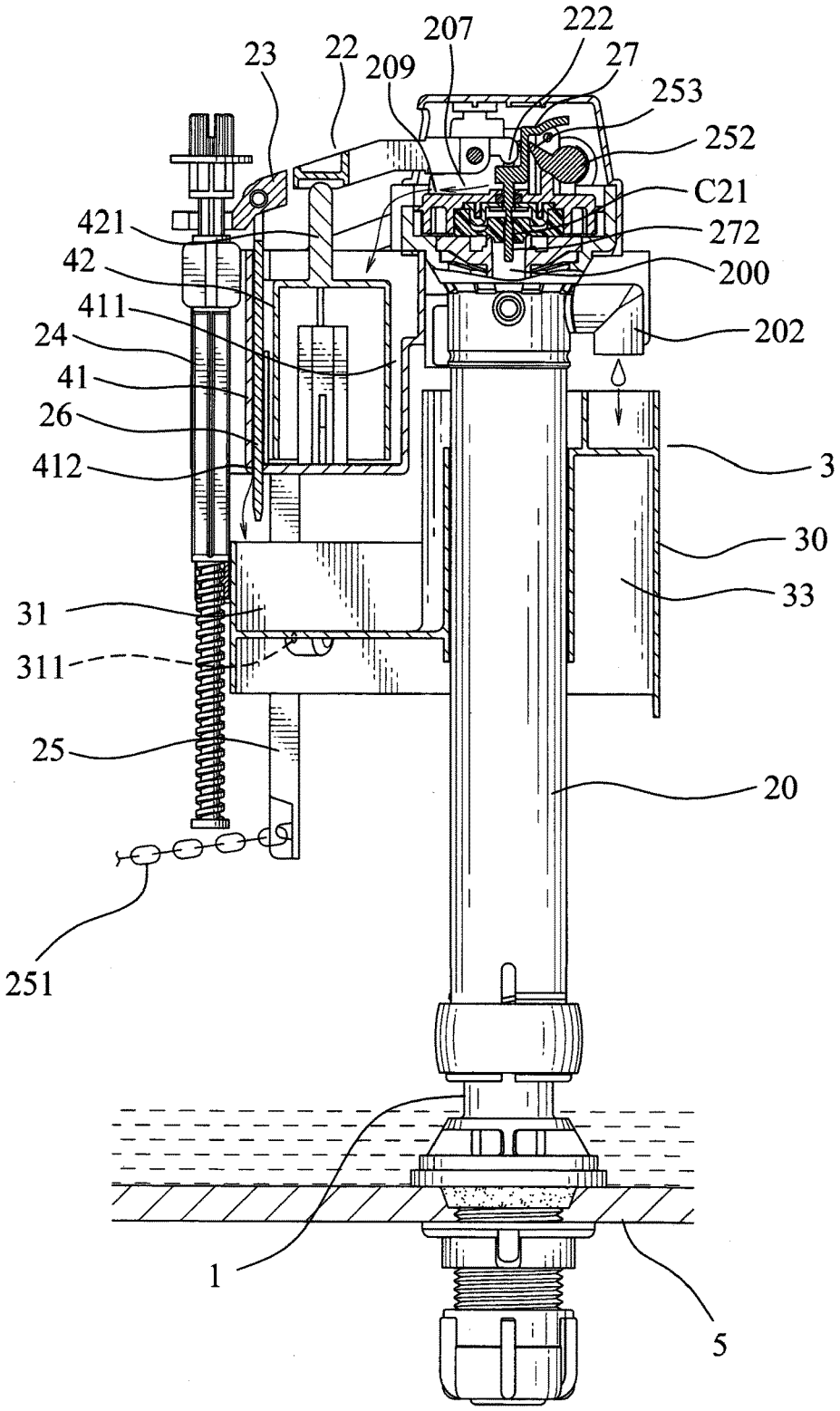
FIG. 10 is a schematic diagram of large amount of water leakage according to the present invention.
Figure 11:
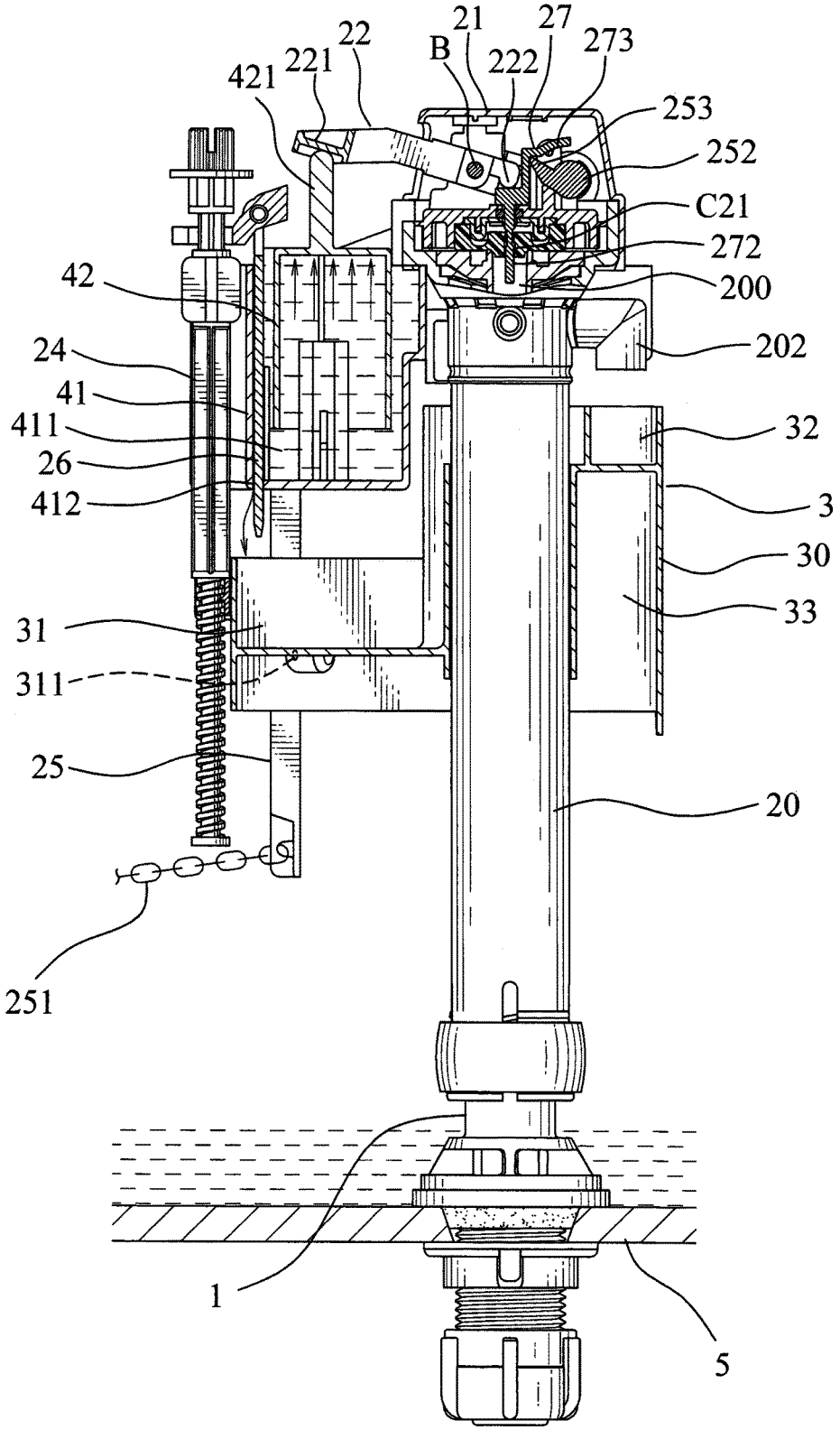
FIG. 11 is a schematic diagram of operation of the assist floating set of the present invention.
Figure 12:
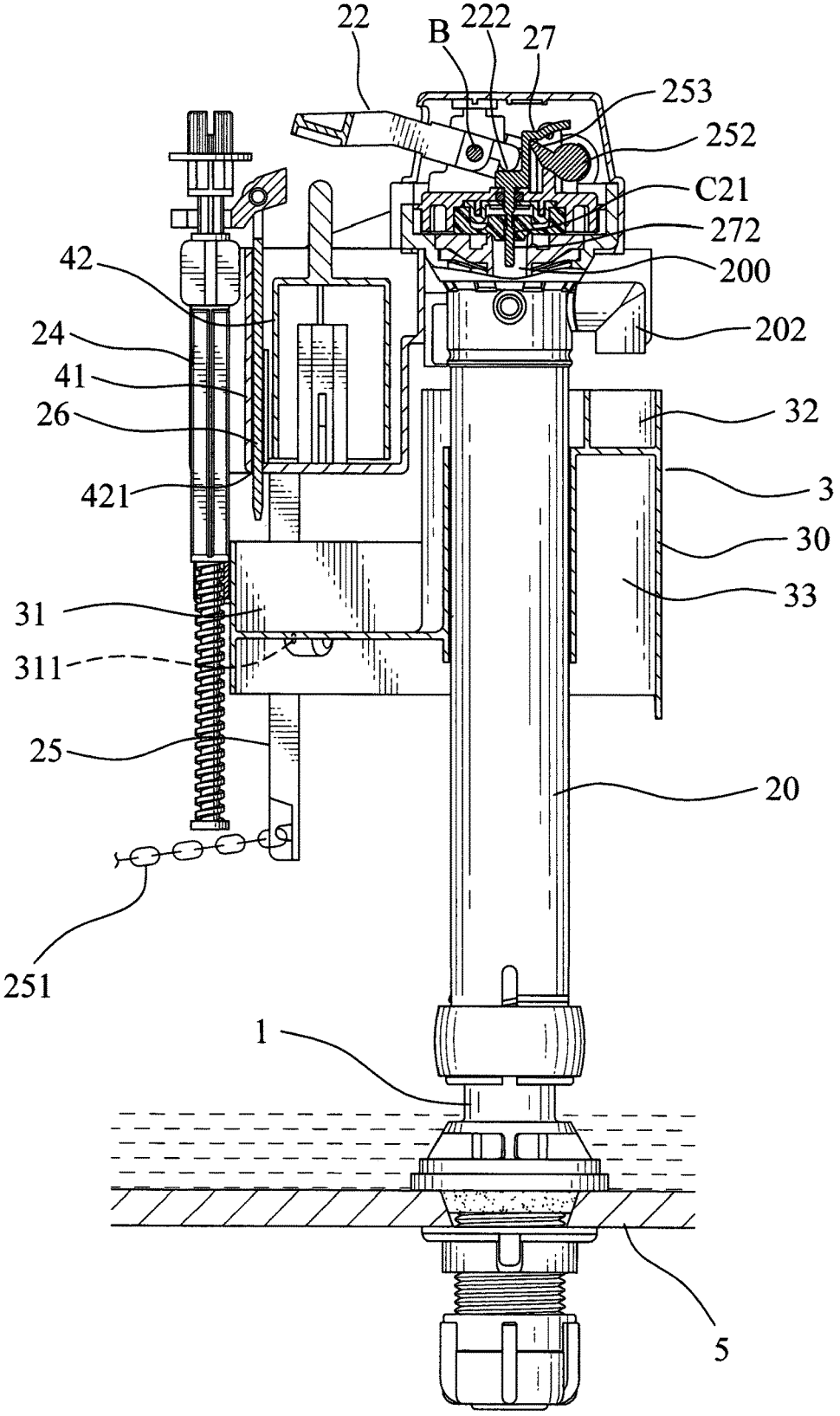
FIG. 12 is a schematic diagram of the assist floating set stopping water according to the present invention.

As shown in FIG. 10, when a large amount of water leakage occurs in the water tank 5, the floating casing 3 quickly moves downwards, since the amount of water leakage is larger than the amount of water flowing in, the floating casing 3 would not move upwards, so that the second terminal 232 of the second connecting rod 23 cannot push the water stopper 27 to stop watering; at this time, by using the present invention, the float 42 could be pushed upwards by the buoyancy of water flowing into the chamber 411, and the top column 421 moves upwards and pushes the pushing portion 221 of first connecting rod 22, so that the first terminal 222 of the first connecting rod 22 pushed downwards on the water stopper 27, since the pushing force is larger than the elasticity of the first spring S1, the latch 272 could move downwards to stop watering (as shown in FIG. 11 and FIG. 12).

Figure 13:
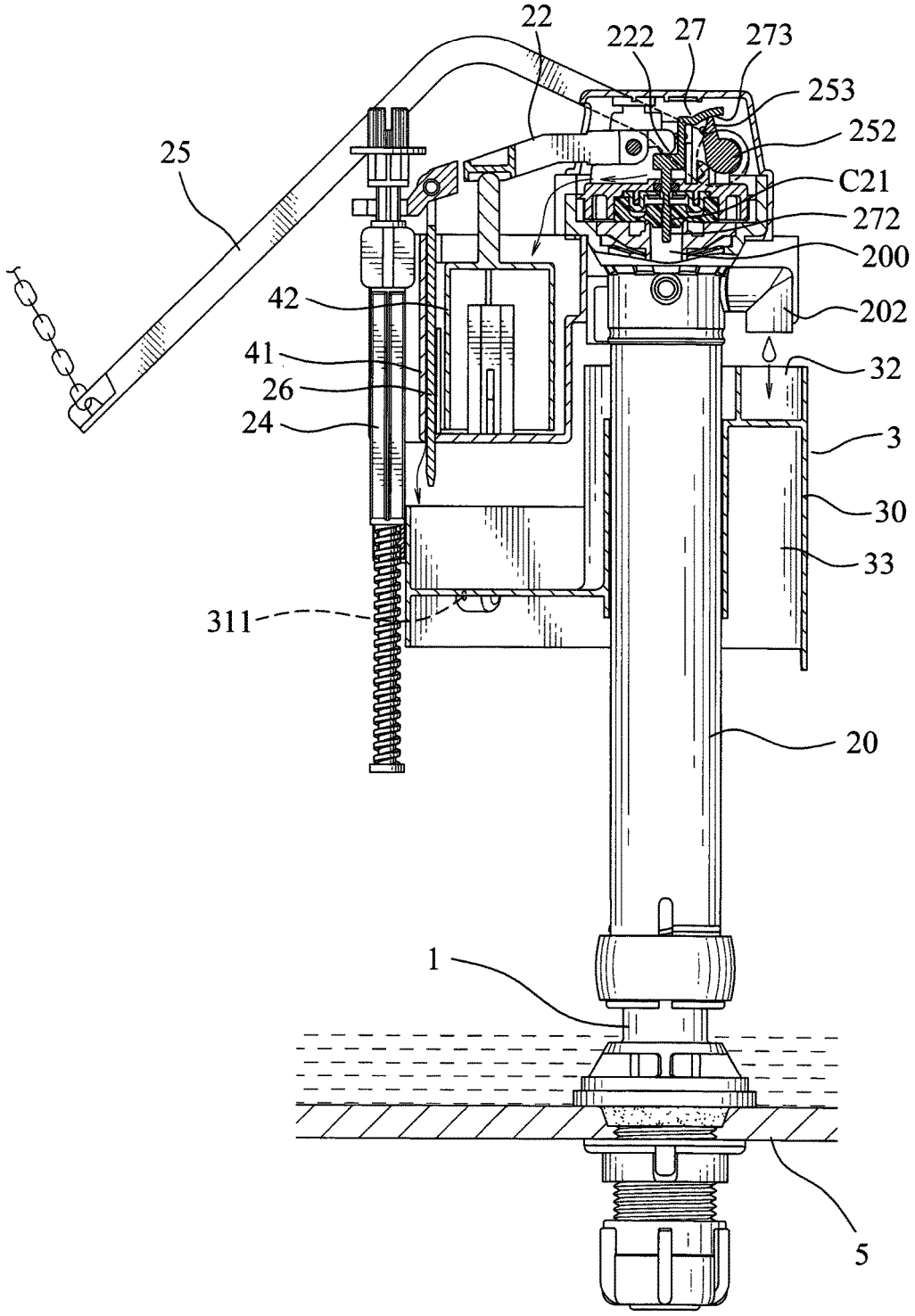
FIG. 13 is a schematic diagram of pressing the flush handle after water stops according to the present invention.

As shown in FIG. 13, the present invention is provided to automatically detect and stop watering of the water inlet device A when water leakage occurs, in this situation, there is no water in the water tank 5, an user presses the flush handle 501 after using the toilet and finds out that there is no water, he would know that the water tank 5 is leaking and needed to repair; also, when the user presses the flush handle 501, the pull rod 502 is driven to pull the second chain 251 upwards, the interlocking rod 25 is driven to rotate and the poke piece 253 is rotated to push the guide section 273 of the water stopper 27, the latch 272 in the through hole C21 is driven to move upwards, so that the water inlet device A starts watering for providing water for flushing, the user should not worry the problem that there is no water to flush.

What is claimed is:

1. An automatic leak-proof water inlet device for a water tank, including:

an inner cylinder having a lower side fixed to a bottom side of the water tank;

an outer cylinder set on an outer periphery of the inner cylinder, the outer cylinder set having an outer cylinder, a cover, a first connecting rod, a second connecting rod, an adjusting rod, an interlocking rod, an insert, a water stopper, a first spring and a second spring; a control seat and an outlet pipe are set on the upper end of the outer cylinder, two first arms corresponding to each other are set on the control seat, an outlet chamber and an outlet pipe are set inside the control seat, the outlet chamber is communicated with an outlet tube, a pad and a socket are set between the outlet chamber and the outlet pipe, a through hole is set on the socket, an outlet hole is set on a side of the outlet chamber; the cover is set on the control seat; a first terminal is set on the inner end of the first connecting rod, a second terminal is set on the inner end of the second connecting rod, the first connecting rod and the second connecting rod is located between the two first arms; an upper end of the adjusting rod is pivoted the outer end of the second connecting rod; one end of the interlocking rod is connected to an end of a second chain, the other end of the second chain is set on a pull rod, a shaft is set on the other end of the interlocking rod, the shaft is set on the control seat, a poke piece is set on the outer end of the shaft; the top end of the insert is connected to the second connecting rod; a latch is set on the bottom side of the water stopper, the latch is inserted into the through hole of the socket, the latch is provided to move up and down to start or stop watering from the outlet pipe; one side of the first spring is fixed to the first connecting rod, the other side of the first spring is fixed to the control seat; one side of the second spring is fixed to the second connecting rod, the other side of the second spring is fixed to the control seat;

a floating casing, a first penetration opening is set on it, the first penetration opening is provided for the outer cylinder to pass through, so that the floating casing is configured to slide up and down outside of the periphery of the outer cylinder; a loading chamber and an inlet chamber are set on the top of the floating casing, the position of the inlet chamber is higher than the loading chamber, a first outlet hole is set on the inlet chamber, a first floating chamber is set on the bottom side of the floating casing, a second outlet hole is set on the bottom of the loading chamber, the second outlet hole is communicated with the first floating chamber, the adjusting rod is connected to the periphery of the floating casing;

an assist floating set, which is set above the floating casing, the assist floating set includes a supporting seat and a float; a second penetration opening is set on the supporting seat, the second penetration opening is provided for the outer cylinder to pass through, a chamber is set on the supporting seat, a third outlet hole is set on the bottom of the chamber, the lower section of the insert is passed out through the third outlet hole; the float is placed in the chamber of the supporting seat, a top column is set on the top side of the float, a second floating chamber is set inside the float.

2. The automatic leak-proof water inlet device for a water tank as claimed in claim 1, wherein an opening is set on a side of the cover.

3. The automatic leak-proof water inlet device for a water tank as claimed in claim 1, wherein a shaft tube, a first positioning hole and a second positioning hole are set on the control seat.

4. The automatic leak-proof water inlet device for a water tank as claimed in claim 3, wherein a third positioning hole and a second shaft hole are set on an inner side end of the first connecting rod.

5. The automatic leak-proof water inlet device for a water tank as claimed in claim 1, wherein a holder and an engaging hole are set on the outer end of the second connecting rod.

6. The automatic leak-proof water inlet device for a water tank as claimed in claim 1, wherein an installation section and an adjusting nut are set on the upper end of the adjusting rod.

7. The automatic leak-proof water inlet device for a water tank as claimed in claim 1, wherein the water stopper includes a top holding portion, a guide section is set upwards on a side of the top holding portion.

8. The automatic leak-proof water inlet device for a water tank as claimed in claim 1, wherein two corresponding second arms are set on the periphery of the floating casing, the second arms are engaged with a positioning collar, a hollow hole is set on the positioning collar.

* * * * *